United States Patent [19]

Schultz

[11] Patent Number: 4,953,872

[45] Date of Patent: Sep. 4, 1990

[54] TRANSPORTATION INDUSTRY GAME

[76] Inventor: Gerald C. Schultz, R.R. 1, Box 47, Bloomfield, Mont. 59315

[21] Appl. No.: 388,842

[22] Filed: Aug. 3, 1989

[51] Int. Cl.[5] ..... A63F 3/00

[52] U.S. Cl. ..... 273/254; 273/256; 273/284

[58] Field of Search ..... 273/254, 256, 278, 281, 273/283, 284

[56] References Cited

U.S. PATENT DOCUMENTS

| | | | |
|---|---|---|---|
| 1,264,984 | 5/1918 | Sharp | 273/254 |
| 2,977,713 | 4/1961 | Alelyunas | 273/281 |
| 4,067,579 | 1/1978 | Boofer | 273/254 |
| 4,426,084 | 1/1984 | Michel | 273/254 |
| 4,679,798 | 7/1987 | Dvorak et al. | 273/254 |

*Primary Examiner*—William H. Grieb

*Attorney, Agent, or Firm*—Arthur L. Urban

[57] ABSTRACT

A method of playing a transportation industry game includes the following steps: There is provided a playing surface with a plurality of adjacent areas forming a first continuous pathway around the surface, a distinguishable marker for each player, a common money supply source, money and stock for each player. Each player in a repeating sequence activates a random number selector and advances the player's marker along the first pathway the number of areas specified by the number selector to stop on a particular area. The legend on the area is read and the action specified is performed. When the legend corresponds to a miniature drive or commodity carrier unit the particular unit is selected and is assembled with a previously selected miniature unit disposed adjacent to a second continuous pathway surrounding the first pathway. When the legend corresponds to that of a particular stack of cards the top card is selected therefrom and the action specified is performed. Stock and money is transferred when specified. Unit assemblies are moved along the second pathway to fulfill contracts when specified. Each player attempts to maximize assets during the playing of the game. Also, the transportation industry game as described above.

20 Claims, 1 Drawing Sheet

TRANSPORTATION INDUSTRY GAME

This invention relates to a novel game and more particularly relates to a new type game.

A large number of different games have been developed through the ages. The games include a multitude of variables. Some games require good physical coordination such as shuffleboard, croquet and the like. Other games require a high degree of mental capability such as bridge, chess and the like.

Games also may be classified according to their playing conditions such as a table, an outdoor area, etc. Games may be further differentiated by the ages of the players. Another criteria may be the type of equipment needed such as a deck of cards, a playing board or the like. In addition, the classification may be whether the game provides educational benefits, relaxation, physical exercise, etc.

Because of the various criteria involved in producing a successful game, a very large number of different games have been proposed in the past and many new games are developed each year. Some of these games are offered to fill a specific interest void in available games. Others are derivatives of a popular game in an attempt to gain a share of the other game's market.

With the development of computers, there has been great interest in games that utilize this technology. In addition to games that can be played on home computers, sophisticated machines have been developed for commercial use in video arcades and similar facilities. Computer based machines also are being used for gambling in the market formerly held exclusively by slot machines. Computer programs now are available for playing traditional casino games such as poker, blackjack and the like.

Although computer games have become very popular, they still are not preferred by many people. Computers and machines based thereon may be intimidating to some older individuals. Also, the major investment in a home computer or the cost of playing commercial machines including computers may exceed the price people are willing to pay for such entertainment.

From the above discussion, it is clear that present games do not satisfy the desires and requirements of a significant number of persons. Thus, there is a need for new games to meet this market.

The present invention provides a novel game with a unique combination of features and advantages not found in previous games. The game of the invention satisfies the desire of people for an adult game which is different from conventional board games. In addition, the game only requires a minimum investment. Also, the game does not utilize complex mechanisms, devices and/or rules that require special attention and concentration on the part of the players.

The game can be played in a wide variety of circumstances and situations in which people find themselves. The game can be played in normal social situations and in addition may be uiilized to educate individuals or groups in the operating and financial complexities of businesses.

The game of the invention can be adapted to simplify the playing thereof by persons with little, if any, knowledge of the business world or conversely can be made more challenging for those with considerable business experience. Thus, the game can be played by people with varied background without their feeling overwhelmed by the rules. Conversely, the rules of the game can be amplified to provide a high level of challenge for more business oriented persons so their interest in the game will be maintained and they will not become bored.

The equipment for the game is simple in design and can be produced relatively inexpensively. Commercially available materials and components can be utilized in the manufacture thereof as well as conventional fabrication methods.

These and other benefits and advantages of the novel game of the present invention will be apparent from the following description and the accompanying drawings in which.

Figure 1:
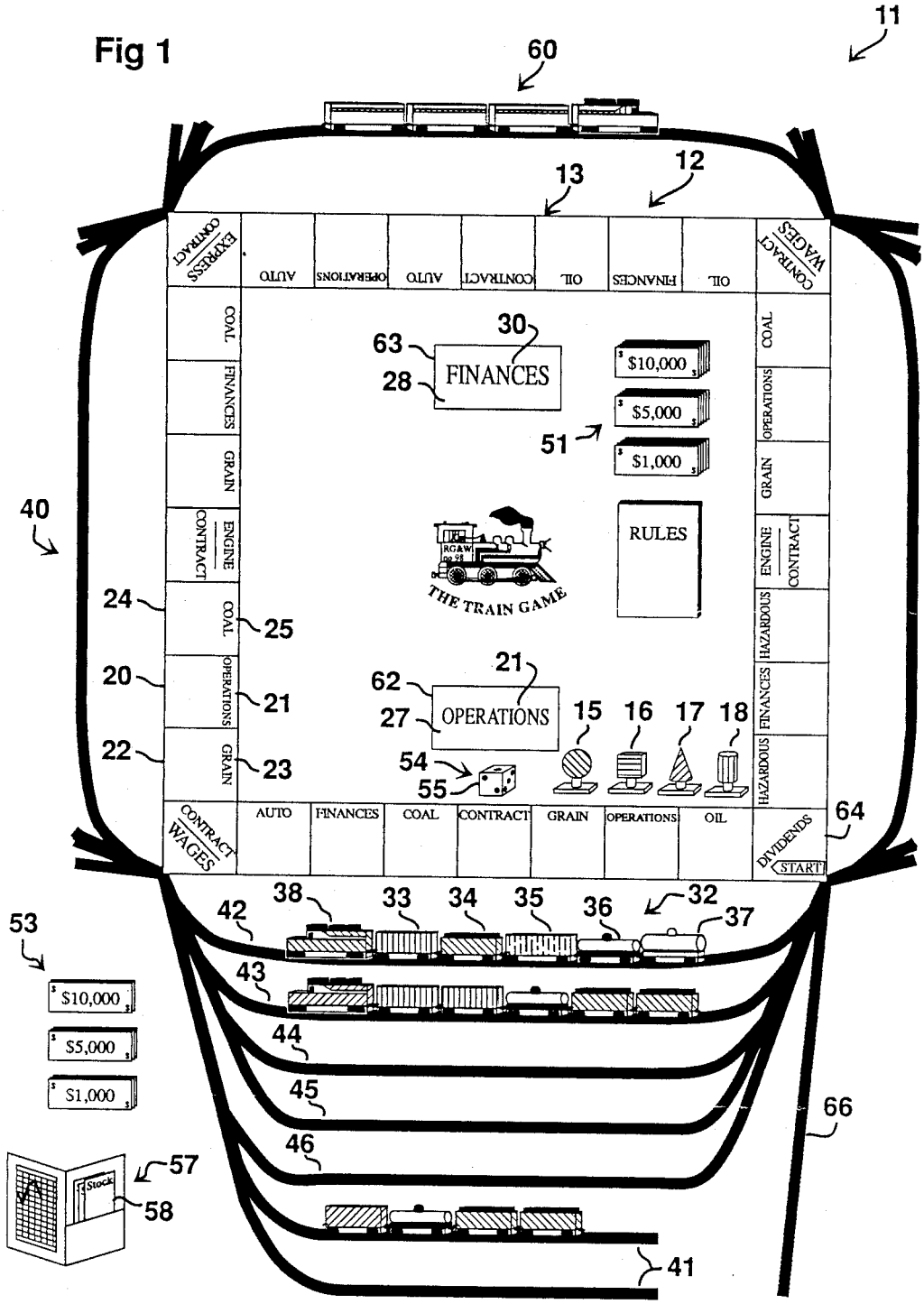
FIG. 1 is a top view of one form of playing surface of the transportation industry game of the invention.

As shown in the drawings, one form of the transportation industry game of the present invention includes a playing surface 11 with a plurality of adjacent areas 12. The adjacent areas 12 form a first continuous pathway 13 around the playing surface 11. A distinguishable marker 15, 16, 17 or 18, one for each player, is movable along the first pathway 13.

Each first pathway area 13 bears a legend different from adjoining areas. Thus, area 20 bears legend 21 "Operations", while areas 22 and 24 on either side thereof have the legends 23 "Grain" and 25 "Coal" respectively.

Stacks of cards 27 and 28 represent particular legends of the first pathway. Stack 27 bears the legend 21 (Operations) and stack 28 has the legend 30 (Finances). The stacks of cards 27 and 28 are piled face down adjacent the playing surface 11. Cards within an individual stack bear the same legend on the back thereof and on the face thereof specify various instructions for actions to be taken by a player during the playing of the game.

Miniature carrier units 32 represent other legends of the first pathway areas 13. As shown with a railroad game, carrier units 32 include grain cars 33, coal cars 34, auto carrier cars 35, oil tank cars 36 and hazardous material tank cars 37.

A second continuous pathway 40 extends around the periphery of the playing surface 11. The second pathway 40 is provided for movement of assemblies of carrier units 32 and drive or power units 38 in the delivery of commodities as will be discribed hereafter. One or more unit assembly areas 41 for each player are located adjacent to the second pathway 40 and accessible thereto. Advantageously as shown in the drawing, alternative pathways 42–46 are included in second pathway 40.

The transproation industry game of the present invention also includes a common money supply source 51. This money serves as a central bank for financial transactions as the game is played. One of the players can serve as a banker to expedite play. At the beginning of the game, each player receives a predetermined amount of money 53.

Random number selection means 54 is included in the game of the invention. The number selection means is used by each player in sequence to determine the number of space or areas 12 along first pathway 13 that a player's marker 15–18 is to be moved in a single turn. Advantageously, the number selection means is employed to make other determinations during the playing of the game, for example, the order of play, value determinations, etc. The number selection means 54 preferably includes one or more dies 55. If desired, each player may be assigned his own die or other selection means.

As pointed out above, the player's markers 15–18 are distinguishable from one another to provide easy identification of the user thereof. The markers may differ in various respects such as color, size shape or other characteristics. As shown in the drawing, the markers are distinguishable by their respective shapes. Marker 15 is a sphere, marker 16 a cube, marker 17 a cone and marker 18 a cylinder.

A stock portfolio 57 is provided for each player. Each stock portfolio includes stock certificates 58. The stock certificates advantageously are "Preferred Stock" convertible to "Common Stock" which can be sold to other players to raise funds. The portfolio preferably includes space for charting changes in the value of the stock together with procedures for converting the stock and declaring bankruptcy. Advantageously, dividends can be paid on the stock and records thereof as well as other stock and financial transactions can be kept by providing charts or similar materials.

The game of the present invention also includes instructions and rules for playing the game. Since the game embraces both the operational and financial aspects of various transportation industries, the instructions and rules furnished with the game are intended to maximize the enjoyment and challenge of playing the game. For persons with particular interests or experience, it may be desirable to modify the instructions and rules to reflect the players'background.

A preferred form of the transportation industry game of the invention may include one or more special unit assemblies 60 which are available for limited periods by different players during the playing of the game. Control of such assemblies, even for limited periods, provides opportunities for the accumulation of additional funds toward winning the game.

In the playing of the transportation game of the present invention, playing surface 11 is positioned on a table or other flat surface (not shown) so the players can sit close to the playing surface. The stacks of Operations cards and Finances cards 27 and 28 are placed face down on designated areas 62 and 63 in the central area of the playing surface. Also, one of the players who has been selected as the banker, distributes equal amounts of money to each player and a stock portfolio including stock certificates. The banker keeps the remaining money in a bank area for future transactions.

Miniature carrier units 32 and drive units 38 are placed in one or more storage areas which are accessible to the players during the playing of the game. The units advantageously are grouped by color or unit type to expedite selection thereof. Each player selects a distinguishable marker 15–18 and places it on starting area 64 of first pathway 13 and selects one drive unit 38, placing it in front of him on one of his unit assembly areas 41.

One of the players is selected to begin the game. This may be accomplished by agreement or more advantageously by each player activating random number selection means 54 shown as die 55 with the player having the highest number starting the game. If more than one player shares the highest number, those players continue until a single high number player remains.

Also, the players agree on the condition that will end the game. One of a number of different conditions can be selected such as when the bank is out of money, when the first player achieves a pre-selected cash value, when a time period selected in advance expires or the like. In each of the recited conditions, the player with the highest cash value wins.

Play begins with the first player activating the random number selection means 54 and moving his marker that number of spaces or areas from the starting area. When the marker comes to rest on an area that corresponds to a miniature unit, either a carrier unit or a drive unit, the particular unit is selected from the storage area and placed in the player's unit assembly area and interconnected with any units already therein.

The marker may land on an area bearing the legend "Contract". This entitles the player to move one of his unit assemblies along the second pathway to deliver the commodities carried thereon. The leading unit assembly is advanced onto the second pathway 40 if it is adjacent thereto. If the leading unit assembly is spaced from the second pathway, the unit assembly is advanced one position toward the pathway.

At the same time, each of the player's following unit assemblies is advanced one position toward the second pathway ready to advance each additional step as his marker lands on "Contract" legends in succeeding turns.

The leading unit assembly advantageously is advanced onto the second pathway to a position adjacent an adjoining side of the playing surface. In succeeding turns when the player's marker comes to rest on an area with the "Contract" legend, the unit assembly will be advanced along the second pathway to portions thereof on successive sides of the playing surface until the unit assembly is ready to return to a position adjacent to the active player's side.

At that point, the leading unit assembly is moved to the player's delivery area 66. The player owning the unit assembly is paid a predetermined amount of money by the bank for each unit delivered. The individual units then are dissembled and returned to the storage area for later selection by the player in the building of new unit assemblies.

The player's marker also may come to rest on areas with other legends such as wages, dividends, etc. When landing on a "Wages" legend, the player must pay wages to the bank in accordance with a predetermined schedule set forth in the rules or agreed upon by the players in advance, e.g. based upon a wage value for each type of miniature unit.

The player is required to pay the dividends to holders of his company's stock when so directed. The dividend rate advantageously is determined by activating the random number selection means 54 with the dividend being a multiple of the number turned up. When a player's marker lands on a space bearing a legend corresponding to a stack of cards shown as "Operations" or "Finances", the player selects the top card from the stack, reads the instructions and performs the action specified. The player simultaneously informs the other players of the instructions on the card. Preferably, this is accomplished by the player reading the instructions aloud, although other ways may by used such a placing the card on a visible part of the playing surface or passing the card from one player to the next. If the instructions on the card or on the first pathway area do not apply to the player's current situation, the player's turn is finished without taking any action.

The instructions on the card or first pathway may relate to the finances, operations and other functions of the company. For example, Finances cards may be for purchasing expenses such as buying fuel or other supplies, etc.; for maintenance expenses for equipment, carrier and drive units, buildings, etc.; as well as for repair expenses resulting from collisions, etc.; miscellaneous expenses for taxes, strikes, etc.; and the like. Other finance cards may relate to stock dividends, stock price changes, stock options, etc.

Examples of "Operations" cards include express delivery or service of regular or special unit assemblies, delays or disruption of service because of strikes, government inspections of equipment, government drug tests of personnel, damage to units resulting from accidents or collisions, etc.

Figure 2:
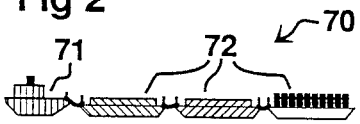
FIG. 2 is a fragmentary side view of another form of miniature unit of the transportation industry game of the invention.
Figure 3:
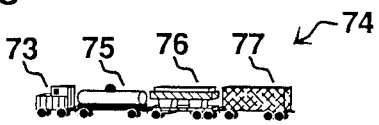
FIG. 3 is a fragmentary side view of a further form of miniature unit of the transportation industry game of the invention.

A preferred method of playing the transportation industry game of the present invention includes picking a specific mode of the transportation industry such as railroading, shipping, trucking, etc. and focusing all phase of the game on that particular mode. For example, a railroading game as shown in FIG. 1 may employ miniature unit representing locomotives, tank cars, hopper and box cars, etc. Also, the stacks of cards and legends on the first pathway areas can utilize specific railroad terminology such as mainline tracks and siding, track warrants, derailments, rails and ties and the like. Similarly, a shipping game (FIG. 2) can utilize miniature units 70 such as boats 71, barges 72, etc. and terminology referring to docks, sinkings storms, low water sand bars, stevedores and the like. In the same way, a trucking game (FIG. 3) can include tractors 73 and various trailer units 74 e.g. tank, hopper and refrigerator trailers 75, 76 and 77 as well as terms such as overload inspections, snowstorms, traffic jams, accidents, etc.

Other game refinements include provisions for changing during play the value of units, both at the time of purchase and at the time of delivery according to some previously agreed upon rules. Also, rules for stock transactions can be more specific such as requiring that a portion of the preferred stock be retained at all times unless the player has entered bankruptcy.

The above description and the accompanying drawings show that the present invention provides a novel transportation industry game and a new method of play with features and advantages not found in previous games. Playing of hte game involves physically moving a miniature transportation unit assembly along a second pathway separate from the moving of players' markers along a different first pathway in response to random number selection. The movement of the unit assemblies is in response to actions taken and instructions received in the movement of the players 'markers along the first pathway as the game is played. In addition, the game and the playing thereof provide the players basic knowledge regarding operations and financial transactions including the transfer of stock and payment of dividends thereon.

These benefits and advantages are achieved in a game that can be produced relatively inexpensively from commercially available materials and components using conventional board game fabricating techniques. The game can be adapted for people with different backgrounds and experience by adding or subtracting details. Also, the rules and instructions can be flexible or restrictive depending upon the standards and desires of the players.

It will be apparent that various modifications can be made in the transportation industry game and method of playing described in detail above and shown in the drawings within the scope of the present invention. The size, configuration and arrangement of the playing surface and other components can be different to meet specific playing and marketing objectives and requirements. Also, the playing rules and instructions can be changed to optimize the enjoyment and challenge for particular groups of players.

These and other changes can be made in the transportation industry game and playing method described provided the playing of the game and interrelationship of components thereof are not adversely affected. Therefore, the scope of the present invention is to be limited only by the following claims.

What is claimed is:

1. A method of playing a transportation industry game including the steps of providing a playing surface with a plurality of adjacent areas forming a first continuous pathway around said surface, a distinguishable marker for each player, a common money supply source, money and stock for each player, each player in a repeating sequence activating random number selection means, advancing the player's marker along said first pathway the number of areas specified by said number selection means to stop on a particular area, reading the legend on said area and performing the action specified, when the legend corresponds to a miniature drive or commodity carrier unit selecting the particular unit and assembling it with a previously selected miniature unit disposed adjacent to a second continuous pathway surrounding said first pathway, when the legend corresponds to that of a particular stack of cards selecting the top card therefrom and performing the action specified, transferring stock and money when specified, moving unit assemblies along said second pathway to fulfill contracts when specified; whereby each player attempts to maximize assets during the playing of the game.

2. A method of playing a transportation industry game according to claim 1 including the step of converting preferred stock to common stock and selling same to other players.

3. A method of playing a transportation industry game according to claim 2 including the step of calculating the value of said common stock before selling same.

4. A method of playing a transportation industry game according to claim 2 including the step of paying dividends on said common stock.

5. A method of playing a transportation industry game according to claim 1 including the step of advancing each waiting unit assembly when a leading unit assembly is moved onto said second pathway.

6. A method of playing a transportation industry game according to claim 1 including the step of advancing a priority unit assembly along said second pathway selectively.

7. A method of playing a transportation industry game according to claim 1 including the step of collecting money from said common money supply source for the delivery of a unit assembly around said second pathway.

8. A method of playing a transportation industry game according to claim 7 including the step of calculating the money to be collected for a unit assembly delivery based on predetermined values for each unit thereof.

9. A method of playing a transportation industry game according to claim 1 including the step of declaring limited bankruptcy when assets of a player are depleted.

10. A method of playing a transportation industry game according to claim 1 including the steps of calulating the total value of assets and comparing totals of the players with player having the highest total being declared winner of the game.

11. A transportation industry game including a playing surface with a plurality of adjacent areas forming a first continuous pathway around said surface, a distinguishable marker for each player movable along said first pathway, each first pathway area bearing a legend different from adjoining areas, stacks of cards representing particular legends of said first pathway areas, said stacks being piled face down adjacent said playing surface, cards within an individual stack bearing the same legend on the back thereof and the faces thereof specifying various instructions for actions to be taken by a player during the playing of the game, miniature drive units and commodity carrier units representing other legends of said first pathway areas, a second continuous pathway around the periphery of said playing surface for movement of assemblies of said drive and carrier units therealong in response to instructions received as said player's marker advances along said first pathway, an assembly area for each player adjacent to said second pathway and accessible thereto, a common money supplying source, random number selection means, a stock portfolio for each player including stock certificates, money for each player, and instructions and rules for moving each player's marker along said first pathway in a repeating sequence and moving said unit assemblies along said second pathway and through the use of said units, money and stock certificates to maximize assets during the playing of the game.

12. A transportation industry game according to claim 11 wherein said miniature drive and commodity carrier units include railroad engines and cars.

13. A transportation industry game according to claim 11 wherein said miniature drive and commodity carrier units include boats and barges.

14. A transportation industry game according to claim 11 wherein said miniature drive and commodity carrier units include tractors and trailers.

15. A transportation industry game according to claim 11 wherein said commodity carrier units include tank, auto carrier, coal and grain units.

16. A transportation industry game according to claim 11 wherein legends of said first pathway areas include auto, coal, grain and oil.

17. A transportation industry game according to claim 11 wherein said miniature unit assemblies include priority unit assemblies.

18. A transportation industry game according to claim 11 wherein said number selection means includes at least one die.

19. A transportation industry game according to claim 11 wherein said stock portfolios include means for recording stock prices and transfers.

20. A transportation industry game according to claim 11 wherein said second pathway and said unit assembly areas are separate from said first pathway.

* * * * *